US006877298B1

(12) United States Patent
Lamoreaux

(10) Patent No.: US 6,877,298 B1
(45) Date of Patent: Apr. 12, 2005

(54) BUNDLER AND STORAGE CONTAINER FOR NEWSPAPER

(76) Inventor: Ray W. Lamoreaux, 364 N. 900 East, American Fork, UT (US) 84003

( * ) Notice: Subject to any disclaimer, the term of this patent is extended or adjusted under 35 U.S.C. 154(b) by 0 days.

(21) Appl. No.: 10/703,994

(22) Filed: Nov. 7, 2003

(51) Int. Cl.[7] ..... B65B 67/00

(52) U.S. Cl. ..... 53/592; 53/582; 53/414; 53/390; 100/34

(58) Field of Search ..... 53/414, 592, 582, 53/390, 413; 100/34; 220/908

(56) References Cited

U.S. PATENT DOCUMENTS

| | | | | | |
|---|---|---|---|---|---|
| 944,823 | A | * | 12/1909 | Rohrer | 100/245 |
| 1,640,452 | A | * | 8/1927 | Knowlton | 206/500 |
| 2,321,802 | A | | 6/1943 | Deubener | 100/19 |
| 2,747,498 | A | * | 5/1956 | Bellar | 100/34 |
| 3,780,854 | A | * | 12/1973 | Ruppenthal | 206/499 |
| 4,150,612 | A | * | 4/1979 | Kessler | 100/2 |
| 4,193,340 | A | * | 3/1980 | Finn | 100/34 |
| 4,558,796 | A | * | 12/1985 | Jaicks | 220/288 |
| 4,681,032 | A | | 7/1987 | McDermott | 100/34 |
| 4,926,748 | A | * | 5/1990 | Smith et al. | 100/34 |
| 4,934,262 | A | | 6/1990 | Turi et al. | 100/34 |
| 4,993,318 | A | | 2/1991 | Bollinger | 100/34 |
| 5,022,316 | A | | 6/1991 | Hellwig | 100/34 |
| 5,072,576 | A | | 12/1991 | Evans | 53/592 |
| 5,114,020 | A | * | 5/1992 | Martin | 211/50 |
| 5,163,579 | A | * | 11/1992 | Jones | 220/629 |
| 5,201,864 | A | * | 4/1993 | Brackett | 100/34 |
| 5,282,545 | A | * | 2/1994 | White | 100/34 |
| 5,388,506 | A | | 2/1995 | Vargas et al. | 100/34 |
| 5,533,318 | A | | 7/1996 | Murat | 53/390 |
| 5,577,440 | A | * | 11/1996 | Marie | 100/34 |
| 5,690,247 | A | * | 11/1997 | Boover | 220/495.11 |
| 6,102,343 | A | * | 8/2000 | Grimesey et al. | 248/95 |
| 6,554,151 | B1 | * | 4/2003 | Brennan | 220/495.04 |
| 6,739,565 | B1 | * | 5/2004 | Spadafora | 248/500 |

* cited by examiner

*Primary Examiner*—Scott A. Smith
*Assistant Examiner*—Gloria R. Weeks
(74) *Attorney, Agent, or Firm*—J. David Nelson

(57) ABSTRACT

A newspaper storage and bundler device having a box shaped container, two pairs of opposing tie studs, each tie stud extending vertically in a stud inset, the stud inset being recessed from the top of a side panel or an end panel with an opposing tie stud extending vertically in a stud inset recessed from the top of the opposing side panel or end panel, each tie stud being anchored to the respective side panel or end panel.

33 Claims, 5 Drawing Sheets

BUNDLER AND STORAGE CONTAINER FOR NEWSPAPER

FIELD OF THE INVENTION

The invention relates to newspaper storage and bundling devices and in particular to bundler containers for storing newspapers as they are discarded and for bundling the newspapers when a desired quantity is accumulated in the container.

BACKGROUND OF THE INVENTION

The ever increasing interest in and need for recycling has resulted in a need for household storage containers for discarded newspaper. Storage containers are needed that also assist in the bundling of the discarded newspaper, preferably with tie material which is recyclable with the newspaper, and thereby facilitate removal of the discarded newspapers from the container and transport to a recycle depository.

A number of devices have been developed to attempt to address these needs. U.S. Pat. No. 2,321,802 to Deubner, U.S. Pat. No. 4,681,032 to McDermott, U.S. Pat. No. 4,934,262 to Turi, U.S. Pat. No. 4,993,318 to Bollinger, U.S. Pat. No. 5,072,576 to Evans, U.S. Pat. No. 5,388,506 to Vargas, and U.S. Pat. No. 5,533,318 to Murat disclose devices for the storage and bundling of discarded newspapers. The present invention provides a new device for storage and bundling of discarded newspapers.

One objective of the present invention is to provide a discarded newspaper storage container and bundler which is simple and economical to construct.

A further objective of the present invention is to provide a discarded newspaper storage container and bundler which is simple to use.

A further objective of the present invention is to provide a discarded newspaper storage container and bundler which can be constructed entirely of recyclable materials.

A further objective of the present invention is to provide a discarded newspaper storage container and bundler which can be constructed entirely of renewable resources.

A further objective of the present invention is to provide a discarded newspaper storage container and bundler which can be constructed of common cardboard and common wooden materials.

SUMMARY OF THE INVENTION

A preferred embodiment of the newspaper storage container and bundler of the present invention is comprised of an open top, box-shaped receiving chamber with a tie stud anchored in a stud inset in each side panel and each end panel of the receiving chamber. Each stud inset extends from the inside surface of the side panel or end panel partially through the panel toward the outside surface a desired stud inset depth and extending from the top of the panel downward a desired stud inset height, the tie stud and the tie stud inset comprising a tie retainer. The tie retainer will generally be centered in panel. The exposed stud length is less than the stud inset height thereby providing for the stud top to be below the top of the left side panel. This allows a lid to be placed on the container bundler without the lid contacting the top of the tie stud.

The inventor prefers embodiments constructed of recyclable materials from renewable resources, particularly favoring paper or wood or combinations thereof, but other types of common box materials, such as plastic or metal, can be used, which are also recyclable. The side panels, the end panels and the bottom panel can be made of one or more layers of cardboard or other common box material. A removal assist member is preferably integral with the bottom panel. For layered alternatives, unitary construction of the panels of each layer can provide additional strength and durability.

A preferred embodiment of the tie retainer provides for tapering of the retainer interior wall, thereby providing for a progressively smaller pinch dimension between the retainer interior wall and the tie stud, thereby providing for securing of ties of various diameters and materials. For preferred embodiments the tie stud is constructed of wood and the anchor end of the tie stud is bonded between layers of the respective side panels and layers of respective end panels. The inventor has found that a tie stud of the general form and dimensions of a coffee stirrer or popsicle stick work well for a tie stud.

The combination of a bottom removal assist member, a bottom panel top layer and bottom layer, and bottom filler layers provide for sufficient strength and durability of the bottom of the container for lifting of the container with or without newspaper containe therein. A simple wood board, preferably hard wood, works well for the removal assist member. The respective ends of the removal assist member are extended beyond the end panel outside surface so that the ends of the removal assist member can be placed under the feet of the user while the user is in a standing position, to hold the container in place while the bundled newspaper is lifted out of the container.

An optional tie feeder may be attached to the underside of the lid. The tie feeder can be square, circular or any other shape. The tie material is extracted by the user through a feed orifice from a spool of the tie material which is preferably wound for extraction from the inside of the spool. For embodiments of the present invention constructed entirely of wood, plastic or other rigid materials, the removal assist member can be integral with the bottom of the container or alternatively can consist of a pair of removal extension members, a respective removal extension member attached to and extending beyond the end panel outside surface of a respective end panel or side panel. The tie retainer is preferably the same for preferred embodiments constructed of wood, plastic or other rigid material as for preferred embodiments constructed of cardboard, but, alternatively, the tie stud can be connected to the inside surface of the side or end panels by fasteners. For embodiments constructed of wood, plastic or other rigid materials, the lid can be connected to the top of a side panel or an end panel with hinges. For embodiments molded, cast or extruded from plastic or other rigid materials, the tie studs can be of unitary construction with the side panels and end panels. For embodiments constructed of wood, plastic or other rigid materials, the tie studs can be connected below the stud inset to the interior surface of the side panels and the end panels with fasteners or other means.

DETAILED DESCRIPTION

Figure 1:
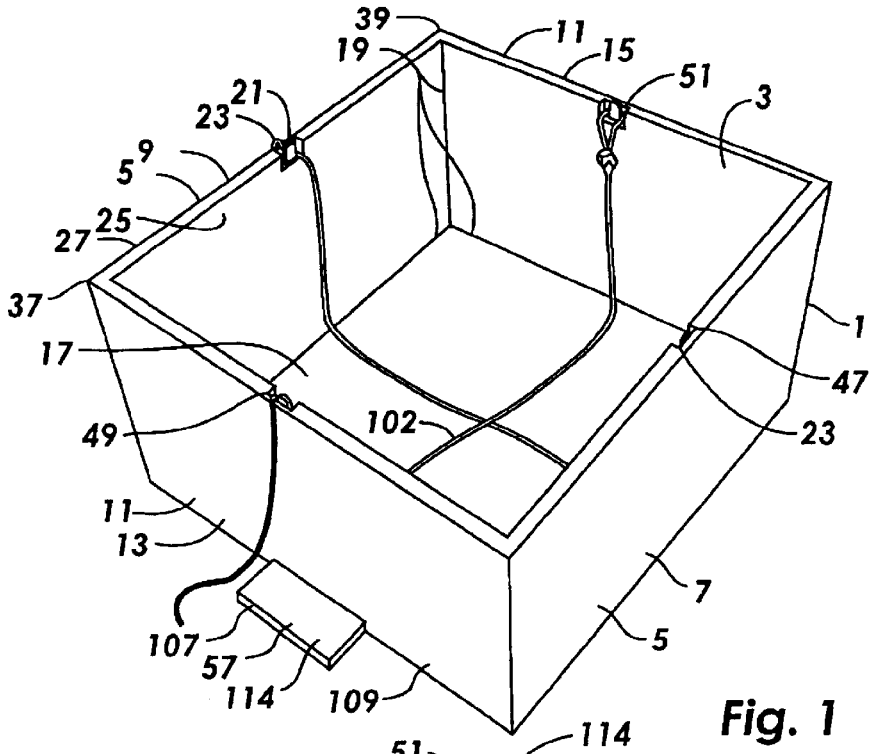
FIG. 1 is a front perspective view of a preferred embodiment of the newspaper storage container and bundler of the present invention with the lid removed.
Figure 2:
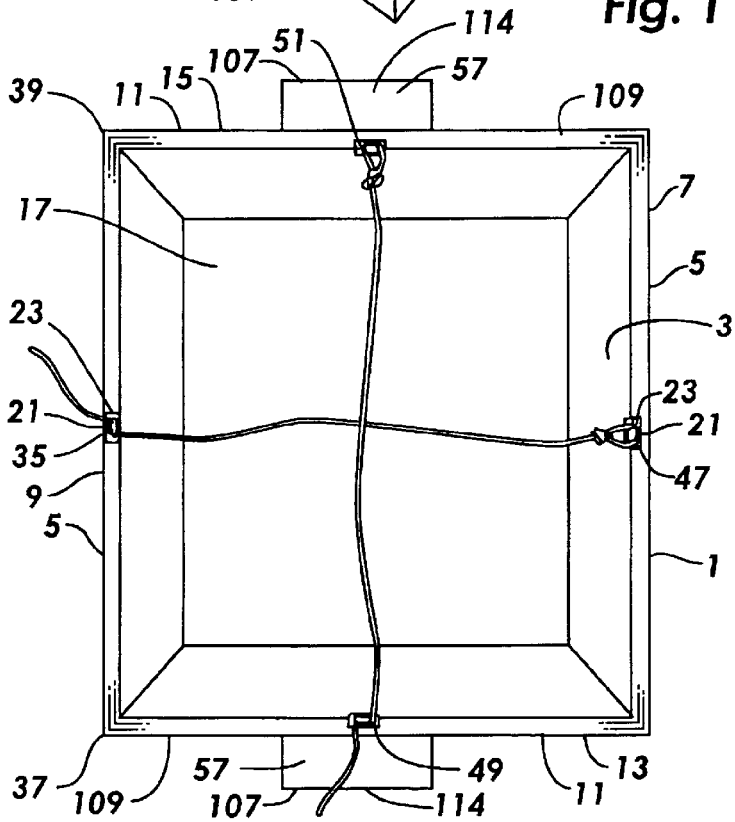
FIG. 2 is a top perspective view of a preferred embodiment of the newspaper storage container and bundler of the present invention with the lid removed.

Referring first to FIGS. 1 and 2, a preferred embodiment of the newspaper storage container and bundler 1 is shown. This embodiment is comprised of an open top, box-shaped receiving chamber 3, the receiving chamber being comprised of a pair of rectangular shaped opposing side panels 5, namely a right side panel 7 and a left side panel 9, a pair of rectangular shaped opposing end panels 11, namely a front end panel 13 and a rear end panel 15, and a rectangular shaped bottom panel 17, edges 19 of the respective panels being connected to form the box-shaped receiving chamber.

Figure 3:
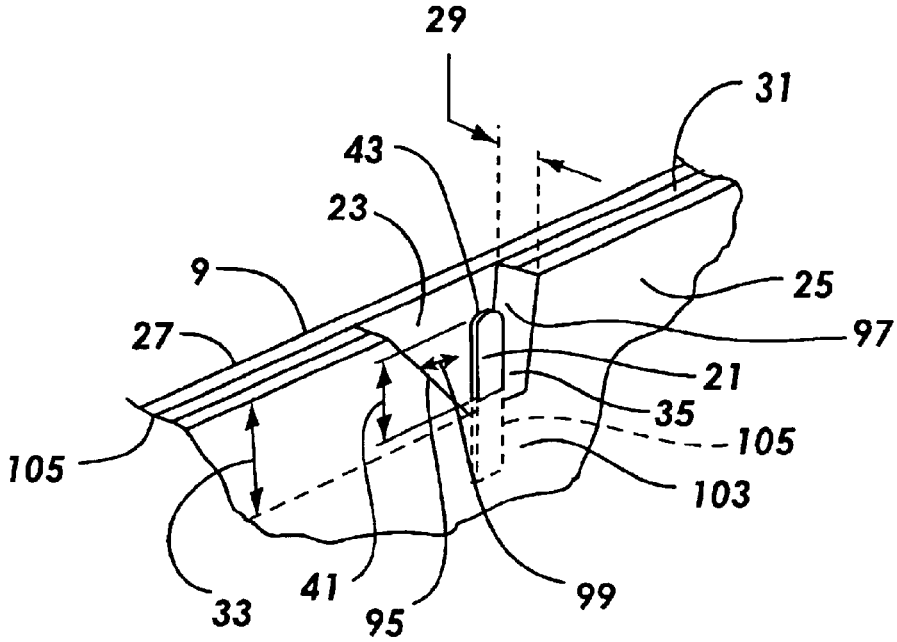
FIG. 3 is a front view perspective detail of a preferred embodiment of a tie retainer of the present invention with tapered interior wall and decreasing pinch dimension.
Figure 12:
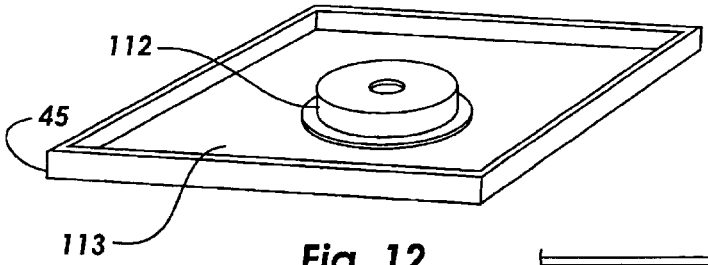
FIG. 12 is a bottom view perspective of a preferred embodiment of a lid and an attached tie dispenser for the newspaper storage container and bundler of the present invention.

Referring also to FIG. 3, a tie stud 21 is anchored in a stud inset 23 in the left side panel 9, the stud inset extending from the left side wall inside surface 25 partially through the left side wall toward the left side wall outside surface 27 a desired stud inset depth 29 and extending from the top of the left side panel 31 downward a desired stud inset height 33, the tie stud and the tie stud inset comprising a left side wall tie retainer 35. The left side wall tie retainer will generally be centered between the left side wall front edge 37 and the left side wall rear edge 39. The exposed stud length 41 is less than the stud inset height 33 thereby providing for the stud top 43 to be below the top of the left side panel 31. This allows a lid 45, an embodiment of which is shown in FIG. 12, to be placed on the container bundler without the lid contacting the top of the tie stud. A right tie retainer 47 is similarly situated in the right side panel, thereby being situated on the opposing side of the receiving chamber. Similarly a front tie retainer 49 and a rear tie retainer 51 will be installed in the front end panel and the rear end panel respectively. The left tie retainer, the right tie retainer, the front tie retainer and the rear tie retainer will generally be identically constructed. The present invention was developed for use in storing and bundling old newspapers with ideological, economical, and durability objectives. The inventor prefers embodiments constructed of recyclable materials from renewable resources. Hence the inventor prefers embodiments constructed of paper or wood or combinations thereof. The embodiment shown in FIG. 1 and FIG. 2 can be constructed entirely of wood or of a combination of cardboard and wood, but other materials, such as plastic or metal, can be used, which are also recyclable. For the preferred embodiment shown, the side panels and the end panels can be made of one or more layers of cardboard or other material. If more than one layer is used the respective layers are bonded together.

Figure 4:
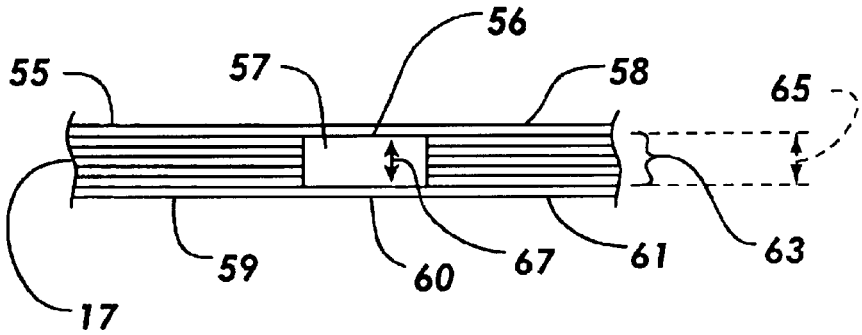
FIG. 4 is a cross-section detail of a preferred embodiment of the bottom panel with removal assist member and filler layers.

Similarly the bottom panel 17 may also be constructed of a plurality of layers of cardboard or other material. For the preferred embodiment shown in FIG. 4, a bottom panel top layer 55 covers the top 56 of a removal assist member 57 thereby producing a uniform top surface 58 for the bottom panel. A bottom panel bottom layer 59 also covers the bottom 60 of the removal assist member thereby producing a uniform bottom panel bottom surface 61. A sufficient number of bottom panel filler layers 63 are used between the bottom panel top layer 55 and the bottom panel bottom layer 59 so that the total filler layer thickness 65 matches the removal assist member thickness 67. The removal assist member is integral with the bottom panel.

Figures 5, 6, 7:
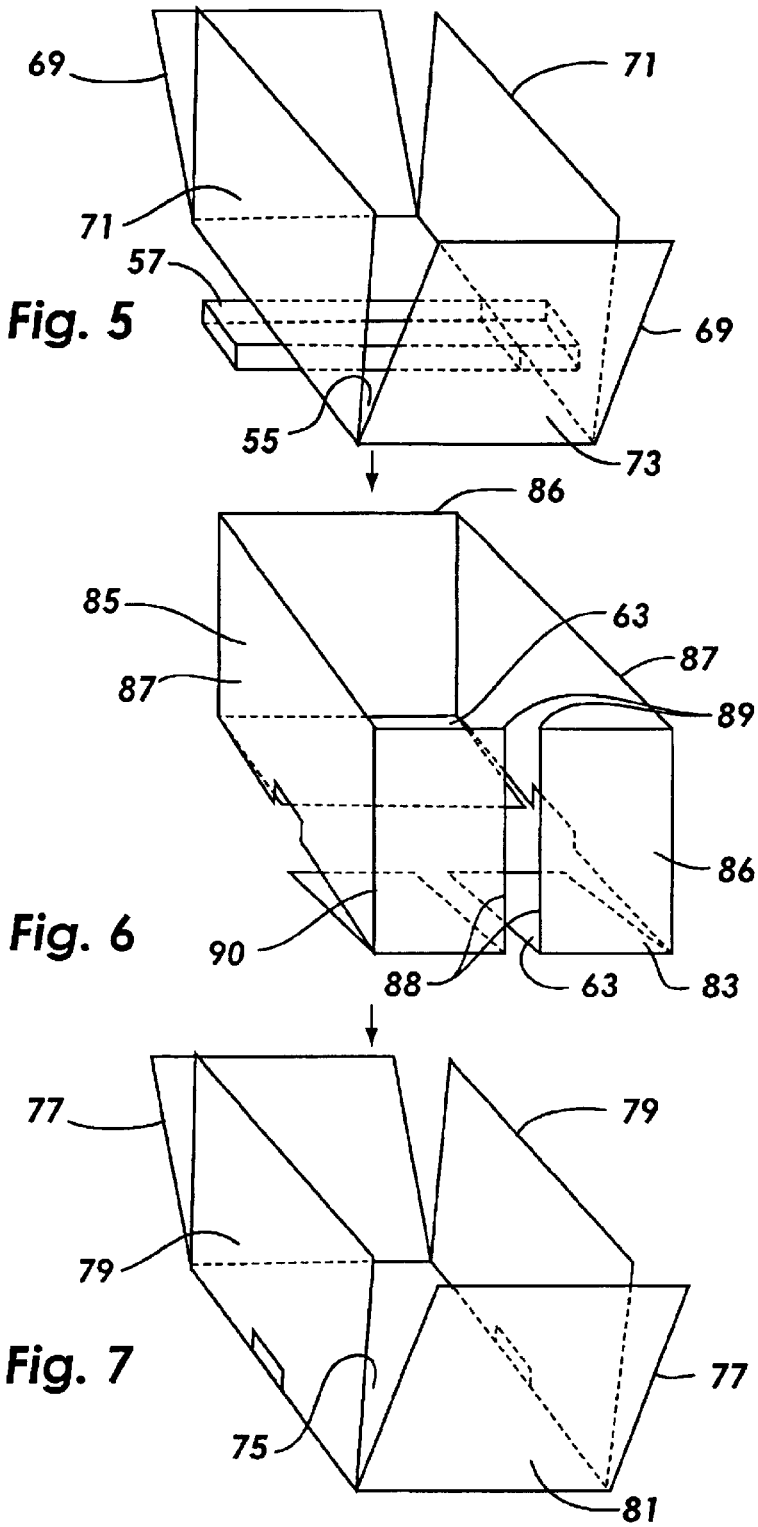
FIG. 5 is an exploded side perspective detail of a preferred embodiment of a unitary interior layer with interconnected bottom panel layer, side panel layers and end panel layers for use in layered construction of certain embodiments of the newspaper storage container and bundler of the present invention.
FIG. 6 is an exploded side perspective detail of a preferred embodiment of a unitary inner layer with interconnected bottom filler layers, side panel layers and end panel layers for use in layered construction of certain embodiments of the newspaper storage container and bundler of the present invention.
FIG. 7 is an exploded side perspective detail of a preferred embodiment of a unitary exterior layer with interconnected bottom panel layer, side panel layers and end panel layers for use in layered construction of certain embodiments of the newspaper storage container and bundler of the present invention.

For preferred embodiments the bottom panel top layer 55 may be of unitary construction with the side panels interior layer 69 and the end panels interior layer 71, by construction from a unitary interior panel 73 of cardboard or other material as shown in FIG. 5. Similarly, the bottom panel bottom layer 75, the side panel exterior layer 77 and the end panel exterior layer 79 may also be constructed of a unitary exterior panel 81 of cardboard or other material as is shown in FIG. 7.

Figure 8:
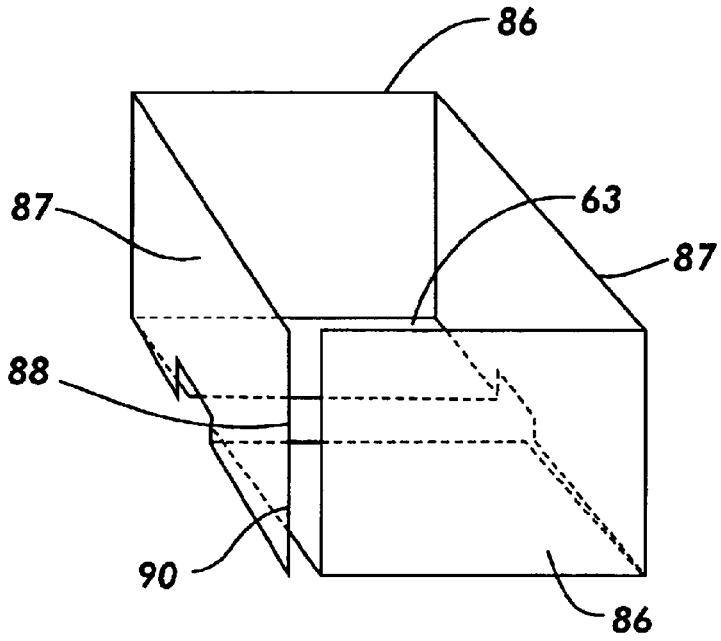
FIG. 8 is an exploded side perspective detail of an alternative preferred embodiment of a unitary inner layer with interconnected bottom filler layers and side panel layers and interconnected side panel layers and end panel layers for use in layered construction of certain embodiments of the newspaper storage container and bundler of the present invention.

For such preferred embodiments one or more unitary inner panels 83 may be used, forming one or more inner layers 85 as shown in FIG. 6, to provide greater strength and durability. For the embodiment shown, the unitary inner panel layer 83 consists of inner side panel layers 86 connected to inner end panel layers 87. By abutting the inner panel ends 88 mid-span 89 in an end panel or a side panel, rather than at a corner 90 the container the container will be strengthened. One or more side panel layers 86 may also be continuous with a bottom panel filler layer 63 as shown in FIG. 6, thereby providing additional strength and durability. Alternatively, for simplicity of construction, the abutting panel ends 88 may be located at a corner 90 as shown in FIG. 8.

Figure 9:
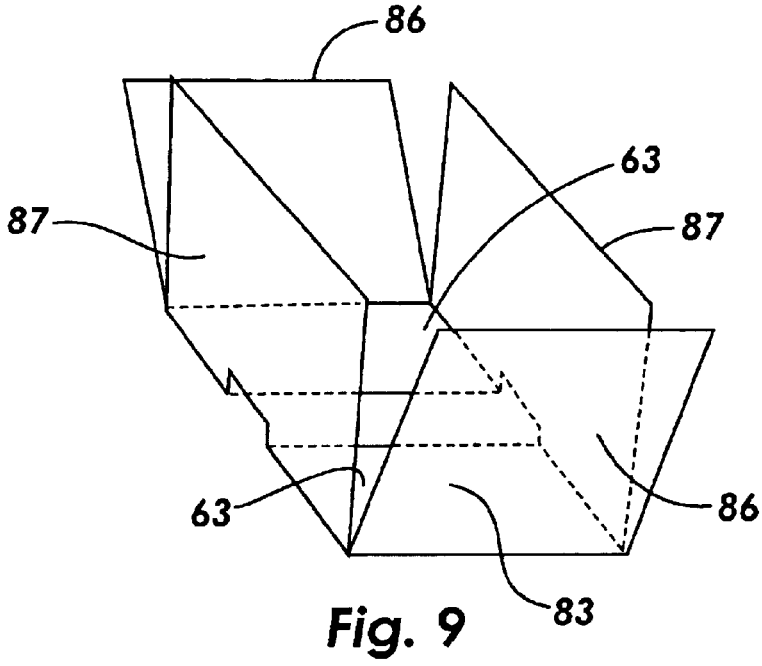
FIG. 9 is an exploded side perspective detail of an alternative preferred embodiment of a unitary inner layer with interconnected bottom filler layers, side panel layers and end panel layers for use in layered construction of certain embodiments of the newspaper storage container and bundler of the present invention.

An alternative unitary inner panel 83 may be constructed as shown in FIG. 9 providing for the bottom filler layers 63 to be unitary with the inner side panels 86 and the inner end panels 87.

Referring now to FIG. 3, a preferred embodiment of the tie retainer 35 provides for tapering 95 of the retainer interior wall 97, thereby providing for a tapered and progressively smaller pinch space 99 between the retainer interior wall and the tie stud 21, thereby providing for securing of ties 102 of various diameters and materials. For preferred embodiments the tie stud can be constructed of wood, plastic, metal or other durable material and the anchor end 103 of the tie stud is bonded in the respective side panels or end panels in a tie stud receptacle 105. For embodiments incorporating layered materials for the side panels, end panels and bottom panels, the anchor end of the tie stud can be bonded between layers of the respective side panels and layers of respective end panels. The inventor has found that a tie stud of the general form and dimensions of a coffee stirrer or popsicle stick work well for a tie stud. Embodiments constructed of plastic or other molded, cast or extruded materials can have a tie stud of unitary construction with the side panel or end panel.

Figure 10:
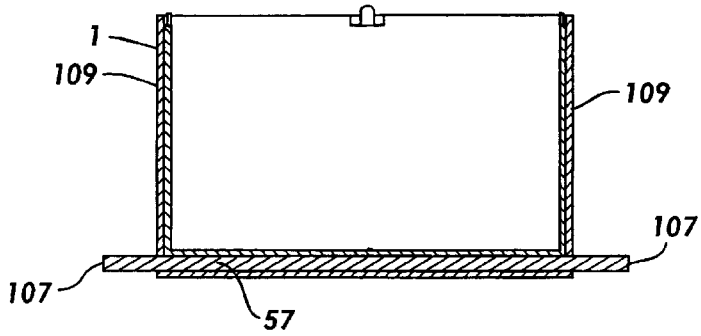
FIG. 10 is a side view cross-section of a preferred embodiment of the newspaper storage container and bundler of the present invention with removal assist member.
Figure 11:
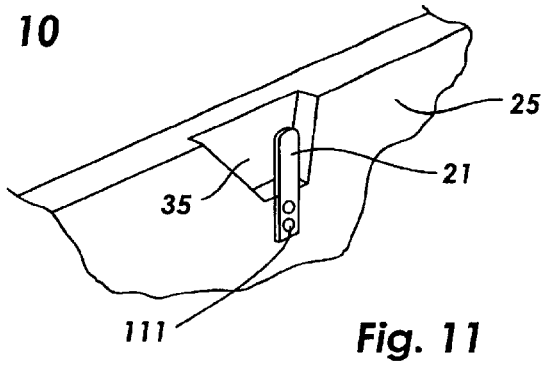
FIG. 11 is a front view perspective detail of an alternative preferred embodiment of a tie retainer of the present invention.

A simple wood board, preferably hard wood, works well for the removal assist member, particularly for embodiments constructed of cardboard or wood. The respective extension ends 107 of the removal assist member extend beyond the end panel outside surfaces 109 and shown in FIG. 1 and FIG. 10. Alternatively, the removal assist member can extend from side panel to side panel across the short dimension of the container. The respective ends of the removal assist member can be placed under the feet of the user with the user in a standing or sitting position to assist the user in removing bundled newspaper. Referring now to FIG. 11, an alternative embodiment of a tie retainer is shown which works particularly well for embodiments of the present invention constructed of wood, plastic or other rigid materials. For this embodiment of the tie retainers 35, the tie studs 21 are connected to the respective side panel inside surfaces 25 and the respective end panel inside surfaces by stud fasteners 111 or other attachment means known in the art. The tie stud will preferably be constructed of metal or other strong and durable material for these embodiments.

Figure 13:
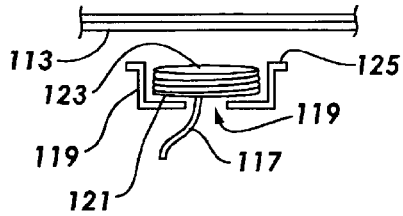
FIG. 13 is an exploded cross-section detail of a preferred embodiment of a tie dispenser for the newspaper storage container and bundler of the present invention.

Referring now to FIG. 12 and FIG. 13, an optional tie feeder 112 may be attached to the underside 113 of the lid 45. The tie feeder will preferably be removably attached to the underside of the lid by attachment means 125 known in the art. Hook and eye fastener material is particularly suited for this application. For the embodiment shown, the tie material 117 is extracted by the user through a feed orifice 119 from a spool 121 of the tie material which is preferably wound for extraction from the inside 123 of the spool. The tie feeder can be square, circular or other shapes which accommodate the spool of tie material.

Referring again to FIG. 1 and FIG. 2, for embodiments of the present invention constructed entirely of wood, plastic or other rigid materials, the removal assist member can be integral with the bottom of the container or alternatively can consist of a pair of removal extension members 114, a respective removal extension member attached to and extending beyond the outside surface of each end panel or side panel.

The tie retainer is preferably the same for preferred embodiments constructed of wood, plastic or other rigid materials as it is for preferred embodiments constructed of cardboard, but, alternatively, the tie stud can be connected to the inside surface of the side or end panels by fasteners as shown in FIG. 11. For embodiments constructed of wood, plastic or other rigid materials, the lid can be connected to the top of an end panel or the top of a side panel by hinges.

What is claimed is:

1. Newspaper storage and bundler device for bundling newspaper with a tie material comprising:

a) box shaped container comprising a bottom panel, a pair of side panels connected to opposing sides respectively of the bottom panel and a pair of end panels connected to opposing ends respectively of the bottom panel and opposing ends respectively of each of the side panels; and b) one or more pairs of opposing tie studs, each tie stud extending vertically in a stud inset, the stud inset being recessed from the top of a side panel or an end panel with an opposing tie stud extending vertically in a stud inset recessed from the top of the opposing side panel or end panel, each tie stud being anchored to the respective side panel or end panel wherein the stud inset is open at the level of the top of the side or end panel, and the stud inset at the level of the top of the side or end panel is spaced from the tie stud to allow vertical insertion of said tie material.

2. Newspaper storage and bundler device as recited in claim 1 further comprising a removal assist member integral to the bottom panel and having opposing extension ends extending from opposing outside surfaces respectively of the side panels or the end panels.

3. Newspaper storage and bundler device as recited in claim 2 wherein the bottom panel of the container has a bottom panel top surface and a bottom panel bottom surface, the removal assist member being confined between the bottom panel top surface and the bottom panel bottom surface.

4. Newspaper storage and bundler device as recited in claim 1 wherein the side panels and the end panels each have an interior panel surface and an exterior panel surface and each stud inset extends from the interior panel surface partially through the respective panel toward the exterior panel surface.

5. Newspaper storage and bundler device as recited in claim 1 wherein the side panels and the end panels each have an interior panel surface and an exterior panel surface and each stud inset extends from the interior panel surface through the respective side panel or end panel to the exterior panel surface.

6. Newspaper storage and bundler device as recited in claim 1 wherein each stud inset has a retainer interior surface and a pinch space between the retainer interior surface and the tie stud.

7. Newspaper storage and bundler device as recited in claim 6 wherein the pinch space is tapered, the pinch space having a pinch dimension which decreases with distance from the top of the tie stud.

8. Newspaper storage and bundler device as recited in claim 1 further comprising a removal assist member extending across the bottom of the container between opposing side panels or opposing end panels, the removal assist member having opposing extension ends extending from opposing outside surfaces respectively of the side panels or the end panels, the removal assist member having a top surface which does not encroach on the storage space of the container and the bottom panel of the device has a uniform interior surface and a uniform exterior surface.

9. Newspaper storage and bundler device as recited in claim 1 wherein each tie stud has a stud interior surface and a stud top surface and wherein the stud interior surface does not protrude into the interior space of the container and the stud top surface does not extend above the top surface of the side panel or end panel in which it is affixed.

10. Newspaper storage and bundler device as recited in claim 1 wherein the bottom panel, the side panels and the end panels are respectively constructed of one or more layers of box material.

11. Newspaper storage and bundler device as recited in claim 10 wherein the box material is cardboard.

12. Newspaper storage and bundler device as recited in claim 10 further comprising a removal assist member integral to the bottom panel and having opposing extension ends extending from opposing outside surfaces respectively of the side panels or the end panels and wherein the bottom panel has a uniform top surface and a uniform bottom surface, the bottom panel having one or more filler layers on each side of the removal assist member.

13. Newspaper storage and bundler device as recited in claim 10 wherein the stud inset has a bottom surface and the tie stud has an anchor portion extending below the stud inset bottom surface and secured in a stud receptacle in the side panel or end panel, whichever is applicable.

14. Newspaper storage and bundler device as recited in claim 10 wherein the stud inset has a bottom surface and the tie stud has an anchor portion extending below the stud inset bottom surface and secured between layers of the side panel or end panel, whichever is applicable.

15. Newspaper storage and bundler device as recited in claim 10 wherein the bottom panel, the side panels and the end panels have respective interior layers which are interconnected in a unitary interior layer.

16. Newspaper storage and bundler device as recited in claim 10 wherein the bottom panel, the side panels and the end panels have respective exterior layers which are interconnected in a unitary exterior layer.

17. Newspaper storage and bundler device as recited in claim 1 wherein the side panels and the end panels each have an interior panel surface and wherein the stud inset has a bottom surface and the tie stud has an anchor portion extending below the stud inset bottom surface and attached to the respective interior panel surface.

18. Newspaper storage and bundler device for bundling newspaper with a tie material comprising:

a) box shaped container comprising a bottom panel, a pair of side panels connected to opposing sides respectively of the bottom panel and a pair of end panels connected to opposing ends respectively of the bottom panel and opposing ends respectively of each of the side panels;

b) one or more pairs of opposing tie studs, each tie stud extending vertically in a stud inset, the stud inset being recessed from the top of a side panel or an end panel with an opposing tie stud extending vertically in a stud inset recessed from the top of the opposing side panel or end panel, each tie stud being anchored to the respective side panel or end panel wherein the stud inset is open at the level of the top of the side or end panel, and the stud inset at the level of the top of the side or end panel is spaced from the tie stud to allow vertical insertion of said tie material; and c) removal assist member integral to the bottom panel and having opposing extension ends extending from opposing outside surfaces respectively of the side panels or the end panels.

19. Newspaper storage and bundler device as recited in claim 18 wherein the side panels and the end panels each have an interior panel surface and an exterior panel surface and each stud inset extends from the interior panel surface partially through the respective panel toward the exterior panel surface.

20. Newspaper storage and bundler device as recited in claim 18 wherein the side panels and the end panels each have an interior panel surface and an exterior panel surface and each stud inset extends from the interior panel surface through the respective side panel or end panel to the exterior panel surface.

21. Newspaper storage and bundler device as recited in claim 18 wherein each stud inset has a retainer interior surface and a pinch space between the retainer interior surface and the tie stud.

22. Newspaper storage and bundler device as recited in claim 21 wherein the pinch space is tapered, the pinch space having a pinch dimension which decreases with distance from the top of the tie stud.

23. Newspaper storage and bundler device as recited in claim 18 further comprising a removal assist member extending across the bottom of the container between opposing side panels or opposing end panels, the removal assist member having opposing extension ends extending from opposing outside surfaces respectively of the side panels or the end panels, the removal assist member having a top surface which does not encroach on the storage space of the container and the bottom panel of the device has a uniform interior surface and a uniform exterior surface.

24. Newspaper storage and bundler device as recited in claim 18 wherein each tie stud has a stud interior surface and a stud top surface and wherein the stud interior surface does not protrude into the interior space of the container and the stud top surface does not extend above the top surface of the side panel or end panel in which it is affixed.

25. Newspaper storage and bundler device as recited in claim 18 wherein the bottom panel, the side panels and the end panels are respectively constructed of one or more layers of box material.

26. Newspaper storage and bundler device as recited in claim 25 wherein the box material is cardboard.

27. Newspaper storage and bundler device as recited in claim 25 wherein the bottom panel has a uniform top surface and a uniform bottom surface, the bottom panel having one or more filler layers on each side of the removal assist member.

28. Newspaper storage and bundler device as recited in claim 25 wherein the stud inset has a bottom surface and the tie stud has an anchor portion extending below the stud inset bottom surface and secured in a stud receptacle in the side panel or end panel, whichever is applicable.

29. Newspaper storage and bundler device as recited in claim 25 wherein the stud inset has a bottom surface and the tie stud has an anchor portion extending below the stud inset bottom surface and secured between layers of the side panel or end panel, whichever is applicable.

30. Newspaper storage and bundler device as recited in claim 25 wherein the bottom panel, the side panels and the end panels have respective interior layers which are interconnected in a unitary interior layer.

31. Newspaper storage and bundler device as recited in claim 25 wherein the bottom panel, the side panels and the end panels have respective exterior layers which are interconnected in a unitary exterior layer.

32. Newspaper storage and bundler device as recited in claim 18 wherein the bottom panel of the container has a bottom panel top surface and a bottom panel bottom surface, the removal assist member being confined between the bottom panel top surface and the bottom panel bottom surface.

33. Newspaper storage and bundler device as recited in claim 18 wherein the side panels and the end panels each have an interior panel surface and wherein the stud inset has a bottom surface and the tie stud has an anchor portion extending below the stud inset bottom surface and attached to the respective interior panel surface.

* * * * *